US006305391B1

(12) United States Patent
Höser

(10) Patent No.: US 6,305,391 B1
(45) Date of Patent: Oct. 23, 2001

(54) CLEANING DEVICE FOR A DRY SHAVER

(75) Inventor: Jürgen Höser, Neu-Anspach (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/341,968

(22) PCT Filed: Jan. 26, 1998

(86) PCT No.: PCT/EP98/00418

§ 371 Date: Jul. 21, 1999

§ 102(e) Date: Jul. 21, 1999

(87) PCT Pub. No.: WO98/35582

PCT Pub. Date: Aug. 20, 1998

(30) Foreign Application Priority Data

Feb. 17, 1997 (DE) ..... 197 05 975

(51) Int. Cl.[7] ..... B08B 3/02

(52) U.S. Cl. ..... 134/111; 134/186; 134/201; 134/190; 134/166 R

(58) Field of Search ..... 134/166 R, 201, 134/182, 184, 185–186, 187, 190, 192, 109, 110, 111

(56) References Cited

U.S. PATENT DOCUMENTS

| | | | |
|---|---|---|---|
| 1,782,792 | * | 11/1930 | Piccione . |
| 3,172,416 | * | 3/1965 | Simmons . |
| 3,759,594 | * | 9/1973 | Cobb . |
| 4,054,963 | | 10/1977 | Taylor . |
| 4,078,558 | * | 3/1978 | Woog et al. . |
| 4,838,949 | * | 6/1989 | Dugrot . |
| 5,121,541 | * | 6/1992 | Patrakis . |
| 5,147,575 | * | 9/1992 | Hampton, Sr. . |
| 5,251,752 | * | 10/1993 | Purohit . |
| 5,515,608 | * | 5/1996 | Zhang . |
| 5,614,030 | * | 3/1997 | Braun . |
| 5,797,059 | * | 8/1998 | Yoshizawa et al. . |
| 5,837,222 | * | 11/1998 | Cloonan et al. . |
| 6,009,622 | * | 1/2000 | Liedblad . |
| 6,131,230 | * | 10/2000 | Manabat . |
| 6,145,657 | * | 11/2000 | Cox . |

FOREIGN PATENT DOCUMENTS

| | | | |
|---|---|---|---|
| 44 02 238 A1 | | 7/1995 | (DE) . |
| 1436302 | | 11/1968 | (DK) . |
| 2 568 111 | | 7/1984 | (FR) . |
| 4-221593 | * | 8/1992 | (JP) . |
| 9-192057 | * | 7/1997 | (JP) . |
| 11-76646 | * | 3/1999 | (JP) . |
| 96/18463 | | 6/1996 | (WO) . |

* cited by examiner

*Primary Examiner*—Frankie L. Stinson
(74) *Attorney, Agent, or Firm*—Fish & Richardson P.C.

(57) ABSTRACT

The invention is directed to a cleaning device for cleaning a shaving head of a dry shaving apparatus, having a housing, a holding device, a cleaning liquid container, a filter, a feed device adapted to be driven by a motor and including a supply pipe leading to a cleaning basin and a liquid drain from the cleaning basin to the cleaning liquid container, so that the cleaning liquid container with an integrated filter is arranged underneath the cleaning basin, the feed device is adapted to be coupled with the inner chamber of the filter, and a backflow of cleaning liquid can be effected from the supply pipe through the filter to the cleaning liquid container.

10 Claims, 4 Drawing Sheets

CLEANING DEVICE FOR A DRY SHAVER

BACKGROUND

This invention relates to a cleaning device for cleaning a shaving head of a dry shaving apparatus, having a housing, a holding device, a cleaning liquid container, a filter, a feed device adapted to be driven by a motor and including a supply pipe leading to a cleaning basin and a liquid drain from the cleaning basin to the cleaning liquid container.

A cleaning device of the type initially referred to is known from DE 44 02 238 C2. In one embodiment of a cleaning device according to this printed specification—FIG. 1—, a cleaning basin is provided with a connector having fitted thereto a porous hose member permeable to cleaning liquid to ensure that dirt particles do not enter the cleaning liquid container. Due to the substantial amounts of dirt particles needing to be removed from the shaving head of a dry shaving apparatus, the hose member is fouled in no time, which prevents cleaning liquid drained from the cleaning basin during the cleaning process from entering the cleaning liquid container. This results in spillage of cleaning liquid from the cleaning device. Approaches aimed at remedying the fouled condition, including in particular the removal of dirt particles, cannot be inferred from this printed specification.

In another embodiment of a cleaning device according to DE 44 02 238 C2—FIG. 6—provision is made for a cleaning liquid container with integrated filter provided in the cleaning liquid circuit between the feed device and the cleaning basin, wherein the cleaning liquid, together with the dirt particles occurring in the respective cleaning operation, is fed by the feed device from the collecting reservoir associated with the cleaning basin directly to the inner chamber of a filter, being retained by this filter. At the beginning of the cleaning operation the feed pump of the cleaning device initially aspirates air, forcing the air through the cleaning liquid container with integrated filter until the cleaning liquid present in the cleaning liquid container reaches the cleaning basin through a conduit and subsequently, through the collecting reservoir, the intake pipe of the feed pump. The continuous accumulation of dirt particles in the inner chamber of the filter presents an increasing resistance in the fluid circuit from the feed device to the cleaning basin, with the result that a feed device having a higher load-carrying capacity and hence incurring greater expense needs to be provided.

SUMMARY OF THE INVENTION

From DE 14 36 302 a backwash precoat filter for gases or liquids is known, in which the supply line for the non purified liquid aspirated by a pump, which line leads to the filter pressure vessel containing the filter elements, as well as the delivery line for the filtrate are each provided with a shutoff valve. The filtrate outlet is disposed at the lower end of the filter elements. Backwash is effected by means of air compressed in an air vessel, steam or gas, with the filtrate outlet of the filter elements being connected with an air vessel, with a shutoff valve being inserted therebetween. The filter pressure vessel further includes a drain connector with a quickacting gate.

It is an object of the present invention to improve a cleaning device of the type initially referred to.

According to the present invention, this object is accomplished in a cleaning device of the type initially referred to with the following features. The cleaning device for cleaning a shaving head of a dry shaving apparatus, includes a housing having a cleaning basin and a holding device, an exchangeable cleaning liquid container containing a cleaning liquid and having a filter integrated therein, and a feed device adapted to be driven by a motor and including a supply pipe leading to the cleaning basin. The cleaning device is characterized in that the exchangeable cleaning liquid container with the filter is arranged underneath the cleaning basin, that the cleaning liquid is adapted to be aspirated by the feed device from the cleaning liquid container through the inner chamber of the filter and to be passed by the feed device to the cleaning basin through a supply pipe, that a backflow of cleaning liquid can be effected from the supply pipe through the feed device and the filter to the cleaning liquid container, and that in a wall of the cleaning liquid container an inlet port is provided admitting the cleaning liquid drained from an outlet port of the cleaning basin.-L The cleaning device of the present invention affords a plurality of advantages. One significant advantage resides in that a fluid circuit optimal in its effect is accomplished by reason of the arrangement of the exchangeable cleaning liquid container with integrated filter underneath the cleaning basin and the subsequent connection of the feed device with the inner chamber of the filter on the one hand and, on the other hand, the further supply of the purified liquid through a supply pipe to the cleaning basin, as well as due to the draining of the cleaning liquid from the cleaning basin into the cleaning liquid container. This fluid circuit ensures that the aggregate of the cleaning liquid is drained from the cleaning basin to the cleaning liquid container and, moreover, that the cleaning liquid present in the supply pipe returns to the cleaning liquid container through the feed device and the filter upon termination of the cleaning operation, that is, upon deactivation of the feed device. An essential advantage afforded by this backflow is that dirt particles collecting on the outer wall of the filter during the cleaning operation when cleaning liquid is drawn from the cleaning basin are dislodged from the filter wall by the pressure of the cleaning liquid flowing back, and are forced into the cleaning liquid container. A further advantage is that the arrangement of the cleaning liquid container underneath the cleaning basin ensures that the filter's surface invariably lies beneath the surface level of the cleaning liquid. Any aspiration of air through the filter during operation of the cleaning device is thus positively precluded. The entire dirt resulting from a cleaning operation of a shaving head of a dry shaving apparatus is fed to, and remains in, the cleaning liquid container. Any accumulation of dirt particles at other locations in the cleaning device is entirely precluded. In consequence it is ensured that the feed device circulates exclusively purified cleaning liquid. The cleaning device as such affords low-cost manufacture because the entire cleaning operation is controlled by a single component only, meaning the feed device.

In a preferred embodiment of the present invention the supply pipe leading from the feed device to the cleaning basin is configured as a riser for the cleaning liquid. By means of the riser an incline is produced for the backflow of cleaning liquid from the supply pipe through the filter into the cleaning liquid container, whose volume and pressure are dimensioned sufficiently large to reduce the filter cake which has accumulated on the outer wall of the filter during the preceding cleaning operation.

In a further embodiment of the present invention the supply pipe is formed by a riser and a downpipe. In a simple and low-cost embodiment of the present invention, the backflow of the cleaning liquid is ensured only by lifting the cleaning liquid to a level in the riser that exceeds the liquid level in the cleaning liquid container.

In an alternative embodiment the backflow of the cleaning liquid is ensured by means of a pressure accumulator. According to this embodiment the pressure accumulator is adapted to be pressurized by the cleaning liquid in operation of the feed device. Still further, deactivation of the feed device ensures the backflow of cleaning liquid through the feed device and the filter to the cleaning liquid container including the removal of dirt particles from the outer wall and the filter by means of the hydrostatic pressure stored in the pressure accumulator. In a further aspect of this embodiment provision is made for the pressure accumulator to be formed by a cylinder piston displaceable against the action of a spring element. Preferably the pressure accumulator is disposed in the riser. In a further embodiment of the present invention the supply of cleaning liquid from the riser to the downpipe is controllable by the pressure accumulator. The arrangement of a pressure accumulator in a supply pipe connecting a cleaning basin disposed above a cleaning liquid container through a feed device and a filter with the cleaning liquid container affords the significant advantage that even in the presence of an insufficient difference between the level of the cleaning liquid in the cleaning liquid container and the inflow of the cleaning liquid through the supply pipe into the cleaning basin, it is nevertheless ensured that a back-flow of sufficient pressure is effected through the feed device and the filter to the cleaning basin for the purpose of removing the filter cake accumulation on the outer wall of the filter.

Further advantages and details of the present invention will become apparent from the subsequent description and the accompanying drawings illustrating a preferred embodiment.

DETAILED DESCRIPTION

Figure 1:
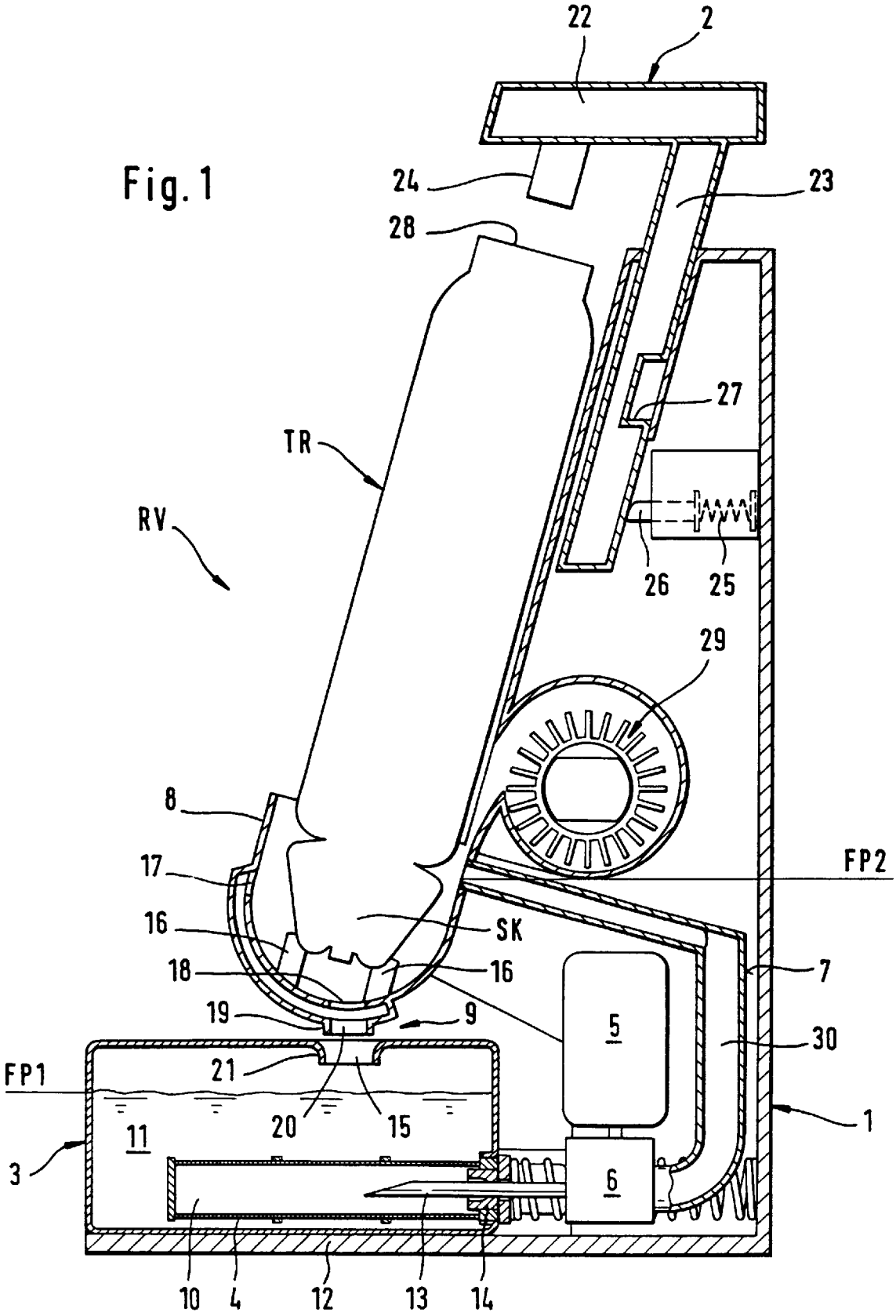
FIG. 1 is a longitudinal sectional view of a cleaning device, comprising a cleaning liquid container with integrated filter underneath a cleaning basin, a feed device, and a supply pipe to the cleaning basin carrying the shaving head of a dry shaving apparatus.

FIG. 1 shows a cleaning device RV for cleaning a shaving head SK of a dry shaving apparatus TR, comprising a housing 1, a holding device 2, a cleaning liquid container 3, a filter 4, a feed device 6 adapted to be driven by a motor 5 and having a supply pipe 7 leading to a cleaning basin 8, and a liquid drain 9 from the cleaning basin 8 to the cleaning liquid container 3.

The cleaning liquid container 3 with an integrated filter 4 is arranged underneath the cleaning basin 8 and above a wall 12 of the housing 1. The feed device 6 is in fluid communication with the inner chamber 10 of the filter 4 through a pipe 13. To establish a liquid-tight coupling between the pipe 13 and the filter 4, a seal 14 is disposed in a wall of the filter 4, the sealing properties of said seal being selected such that the requisite sealing effect is ensured not only with the pipe 13 inserted but also when the cleaning liquid container 3 with integrated filter 4 is subsequently uncoupled from the pipe 13.

The inner curvature of the cleaning basin 8 conforms approximately to the outer contour of a shaving head SK of a dry shaving apparatus TR, holding only as much cleaning liquid as is necessary for the particular cleaning operation. To support the shaving head SK, provision may be made, for example, for two supporting elements 16 made of an elastic material on the bottom of the cleaning basin 8. The cleaning basin 8 includes an over-flow device 17 to prevent the cleaning liquid 11 from exceeding a defined level in the cleaning basin 8, thus ensuring that only the shaving head SK or part of the shaving head SK is immersed in cleaning liquid 11 when the cleaning device RV is in operation. In this embodiment the liquid drain 9 from the cleaning basin 8 to the cleaning liquid container 3 is formed by an outlet port 18 in the cleaning basin 8, with the outlet port's area of cross section being also adapted to control the level of the cleaning liquid in the cleaning basin, by a further outlet port 20 configured as a connector 19, and by an inlet port 15 configured, for example, as a funnel 21 in the cleaning liquid container 3. For handling the exchangeable cleaning liquid container 3, for example, the inlet port 15 is closable with a cover—not shown.

The dry shaving apparatus TR rests on the supporting elements 16 in the cleaning basin 8 where it is held by means of an adjustable holding device 2. The holding device 2 is formed essentially by a wall 23 extending parallel to a wide dimension of the dry shaving apparatus TR, and by a wall 22 associated with the bottom wall of the dry shaving apparatus TR. Provided on the wall 22 is a retaining element 24 configured as a coupler plug. The wall 23 of the holding device 2 coupled with the wall 22 is slidably mounted in the housing 1, for example, parallel to the wide dimension of the housing of the dry shaving apparatus TR, in such manner that a displacement of the holding device 2 in the direction of the cleaning basin 8 ensures coupling of the retaining element 24 configured as coupler plug with the coupler socket 28 of the dry shaving apparatus TR, while a displacement of the holding device 2 in the opposite direction ensures uncoupling of the holding device 2 from the dry shaving apparatus TR. Coupling the plug of the retaining element 24 with the socket ensures, through the connection to the electric circuit provided in the cleaning device for operating the feed device and/or fan device, an electric voltage supply for various purposes including, for example, an activation of the electric drive mechanism of the dry shaving apparatus TR by hand or under automatic control when the cleaning device RV is set in operation, and/or a recharging operation of a dry shaving apparatus TR equipped with a rechargeable storage cell following deactivation of the cleaning device RV. Operation of the dry shaving apparatus during the cleaning cycle supports the cleaning action of the cleaning liquid 11 due to the oscillating motion of a cutting element provided in the shaving head of the dry shaving apparatus and the attendant swirl of the cleaning liquid 11 in the shaving head.

The cleaning device of FIG. 1 makes provision for a fan device 29 supplying air for drying the shaving head SK upon completion of the cleaning cycle, that is, after all of the cleaning liquid 11 is drained from the cleaning basin 8. Activation and deactivation of the fan device 29 may be part of a switching program of a programmable switching device—not shown—and/or controllable separately by hand.

Provided in the housing 1 is a latching device which is formed by a spring element 25, a detent element 26 and a notch 27. The notch 27 is disposed in the wall 23 of the holding device 2 in such manner that in the course of the displacement of the holding device 2 for holding the dry shaving apparatus TR in a position suitable for cleaning the shaving head SK the detent element 26 acted upon by the spring element 25 engages with the notch 27, arresting the holding device 2 with the dry shaving apparatus TR in this position.

In the embodiment of FIG. 1 the cleaning liquid 11 is fed by the feed device 6 through a supply pipe 7 to the cleaning basin 8 disposed above the cleaning liquid container 3. The supply pipe 7 is configured as a riser 30 whose liquid level FP2 is determined by the mouth of the riser opening into the cleaning basin 8. The level difference between FP2 and the level FP1 of the cleaning liquid 11 in the cleaning liquid container 3 is selected such that following deactivation of the feed device 6 the ensuing backflow of cleaning liquid 11 through the feed device 6 and the filter 4 causes dirt particles adhering to the outer wall of the filter 4 to be dislodged from the filter wall and urged into the cleaning liquid container 3.

Figure 2:
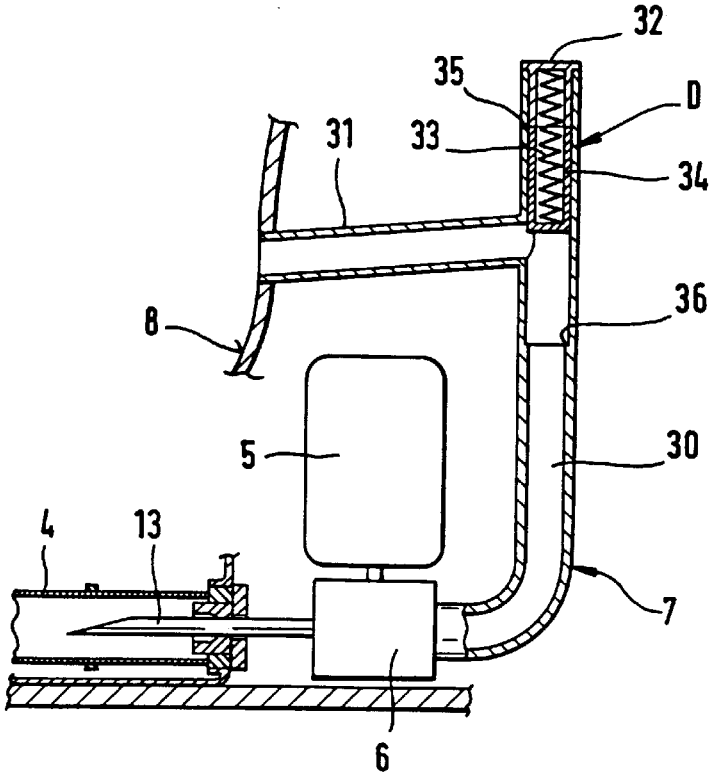
FIG. 2 is a view of a motor-driven feed device having one end thereof coupled with a filter through a pipe while its other end is coupled with a cleaning basin through a supply pipe with built-in pressure accumulator.

FIG. 2 shows a further embodiment of a supply pipe 7 leading from the feed device 6 to the cleaning basin 8. The supply pipe 7 is subdivided into a riser 30 and a downpipe 31. In the area of the branch of the downpipe 31 from the riser 30 to the cleaning basin 8, the riser 30 accommodates a pressure accumulator D comprising a cylinder piston 34 displaceable against a spring element 33. The end of the spring element 33 remote from the cylinder piston 34 bears against the cover 32 providing a liquid-tight seal for the riser 30. An annular wall of the cover 32 extends into the riser 30, forming, for example, a stop 35 for the cylinder piston 34 to limit the piston stroke in the riser 30. A further stop 36 limiting the stroke of the cylinder piston 34 in opposition to the direction of flow of the cleaning liquid 11 is formed, for example, by a reduced enlargement of the inside diameter of the riser 30 in the area of the junction with the downpipe 31.

Activation of the feed device 6 causes cleaning liquid 11 to be aspirated from the cleaning liquid container 3 through the filter 4 and to be conveyed in the riser 30 of the supply pipe 7 in the direction of the pressure accumulator D. The feed pressure of the cleaning liquid 11 moves the cylinder piston 34 against the pressure of the spring element 33, displacing the cylinder piston in the direction of the stop 35. As this displacement occurs, the cylinder piston 34 releases the opening of the downpipe 31 leading to the cleaning basin 8, enabling the cleaning of a shaving head SK of a dry shaving apparatus TR held in the cleaning basin 8. Upon deactivation of the feed device 6 and the attendant drop in the feed pressure of the cleaning liquid 11, the cylinder piston 34 of the pressure accumulator D acts on the cleaning liquid 11 by means of the energy stored in the spring element 33, forcing the cleaning liquid 11 through the feed device 6 and the pipe 13 into the inner chamber 10 of the filter 4 and onward through the filter wall back into the cleaning liquid container 3. The volume and pressure magnitudes of this backflow of cleaning liquid 11 effected by the pressure accumulator D are selected such that dirt particles adhering to the outer wall of the filter 4 are dislodged therefrom and moved into the inner chamber of the cleaning liquid container 3. In contrast to the embodiment of FIG. 1, the arrangement of a pressure accumulator D in a supply pipe 7 leading from a feed device 6 to a cleaning basin 8 represents an alternative embodiment for freeing the outer wall of a filter 4 of dirt particles by the backflow of the cleaning liquid 11.

Figure 3:
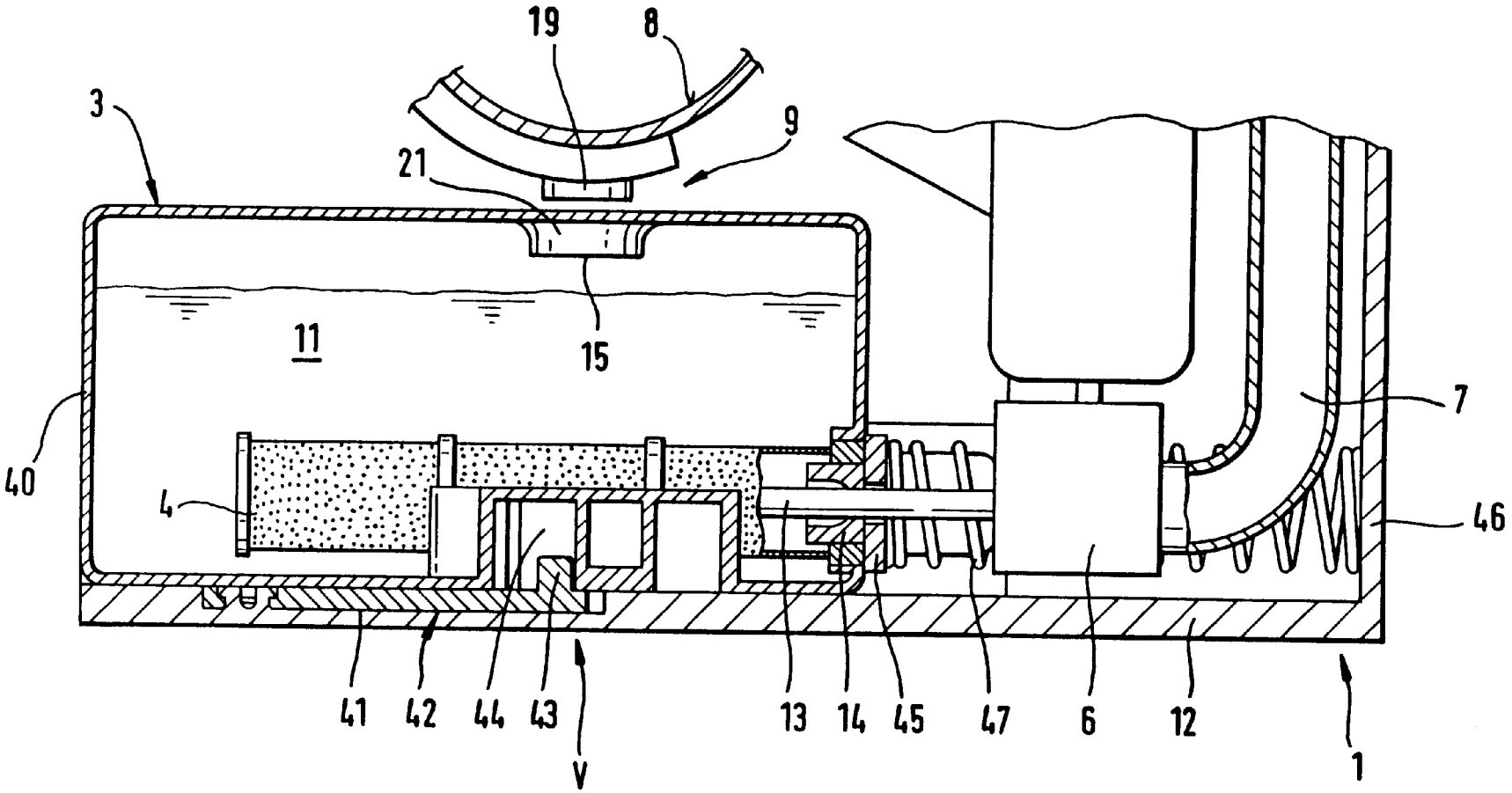
FIG. 3 is a sectional view of the lower part of a cleaning device, in particular of a cleaning liquid container with integrated filter and a latching device coupling a wall of the housing with the cleaning liquid container, and of a feed device with the supply pipe connected thereto.

FIG. 3 shows details of a proper positioning of a cleaning liquid container 3 with integrated filter 4 in the housing 1 of the cleaning device RV. Provided in a wall 12 forming the bottom of the housing 1 is a recess 41 receiving pivotally therein a control element 42 having a control cam 43 protruding from the recess 41. The control cam 43 is in engagement with a guideway 44 provided on the outside of a wall 40 of the cleaning liquid container 3. The latching device V maintains the cleaning liquid container 3 in a latched position provided in the guideway 44 using, for example, the effect of the pressure of a spring element 47 resting with one end against an abutment 46 provided on the housing 1 while its other end bears against a pressure transmitting element 45 resting against the wall 40 of the cleaning liquid container 3. A pipe 13 passing through the seal 14 connects the inner chamber of the filter 4 with the feed device 6 delivering the cleaning liquid 11 through the supply pipe 7 to the cleaning basin 8. With the cleaning liquid container 3 latched with the wall 12 of the housing 1 as shown, the inlet port 15 configured as a funnel 21 is located underneath the connector 19 provided on the outlet port 20 of the overflow device 17 of the cleaning basin 8, whereby the fluid circuit is established from the cleaning liquid container 3 through the filter 4, the pipe 13, the spring elements, the supply pipe 7 to the cleaning basin 8.

Details of the structure of the latching device V are illustrated in the sectional view of FIG. 4 and will be described in more detail in the following.

Figure 4:
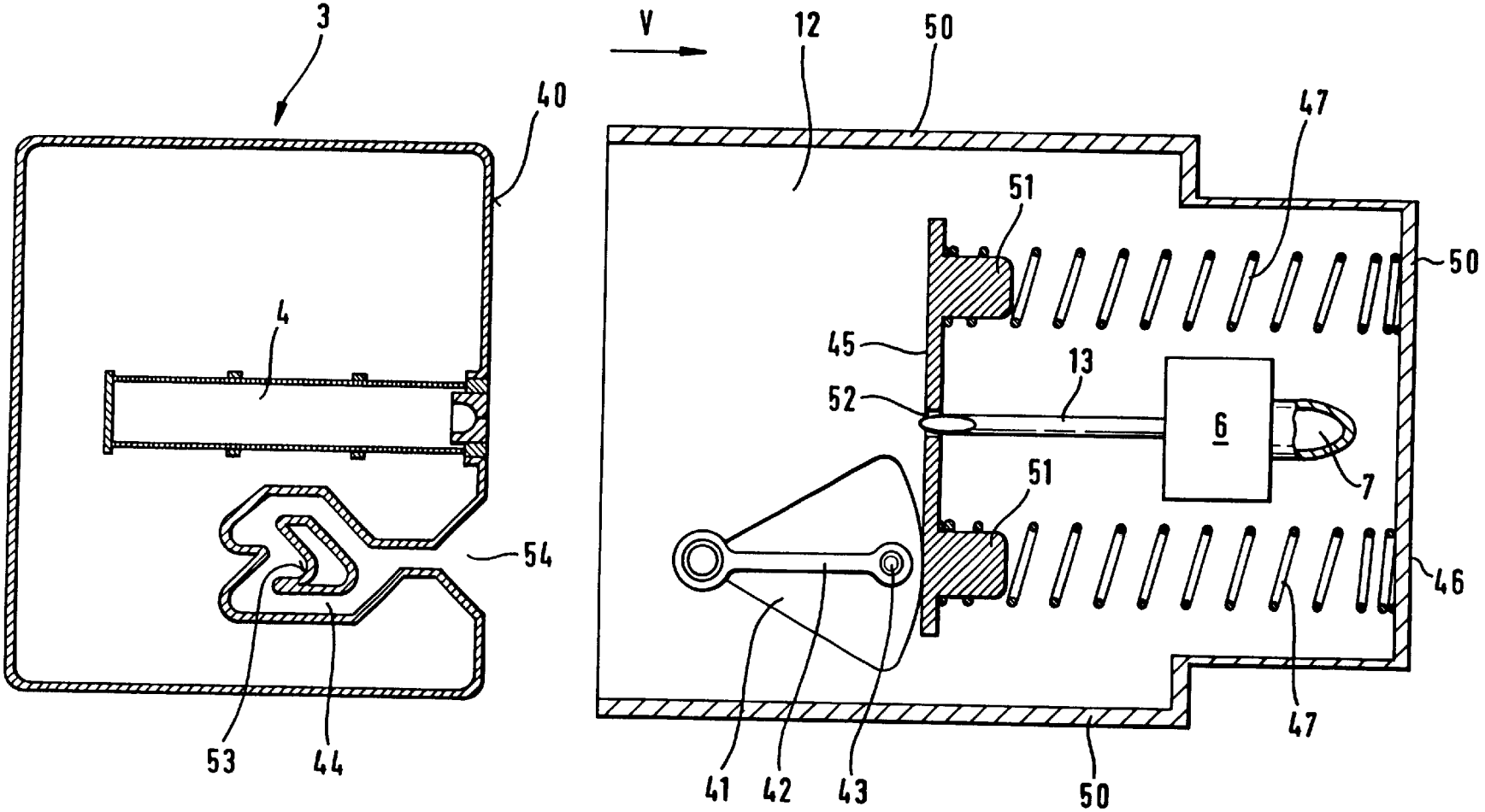
FIG. 4 is a sectional view of the lower part of the housing of the cleaning device, showing a pressure transmitting element acted upon by spring elements, and a control element with a control cam for coupling the cleaning liquid container, shown adjacent thereto in section and having a guideway and a lead-in path.

FIG. 4 shows a section through several side walls 50 of the housing 1 so that the wall 12 representing the bottom of the housing 1 is visible. Formed into the wall 12 is a recess 41 receiving pivotally therein a control element 42 configured as a one-armed lever having a control cam 43 integrally formed thereon. This embodiment further shows a pressure transmitting element 45 having locating elements 51 integrally formed thereon for guiding spring elements 47 which bear against an abutment 46 formed by a side wall 50 of the housing 1. Shown between the two spring elements 47 extending in spaced relation parallel to each other is the feed device 6 with a plug-in tube 13. With the spring elements 47 in released condition, the plug-in tube 13 projects into an opening 52 provided in the pressure transmitting element 45, and it is adapted to be coupled with the filter 4 disposed in the cleaning liquid container 3 on displacement of the pressure transmitting element 45.

FIG. 4 further shows a section through the wall 40 of the cleaning liquid container 3 with built-in filter 4, illustrating also the path of the guideway 44 from a lead-in path 54 open from an outside to a latching position 53. The guideway 44 has essentially the contour of a heart in which the lead-in path 54 is directed at an outer tip of the heart, while the latching position 53 is formed by the inner lying tip of the heart.

For the purpose of coupling the cleaning liquid container 3 with the housing 1, the cleaning liquid container 3 is inserted between the two parallel side walls 50 of the housing 1. As this movement proceeds, the control cam 43 of the control element 42 projecting from the recess 41 engages with the leading path 54, continuing its course along the guideway 44 until it reaches the latching position 54. As the control cam 43 enters the lead-in path 54, the wall 40 of the cleaning liquid container 3 engages the pressure transmitting element 45, moving it against the pressure of the spring elements 47 in the direction of the arrow V until the control cam 43 has reached the latching position 53. On completion of the displacement of the cleaning liquid container 3 in the direction of the arrow V, the cleaning liquid container 3, under the action of the spring tension of the spring elements 47, is urged against the control cam 43 and held in the latching position 53. By exerting again pressure on the cleaning liquid container 3 in the direction of the arrow V, the control cam 43 with the control element 42 is disengaged from the latching position 53 in the guideway 44, performing a controlled movement along the guideway 44 to the lead-in path 54, so that the cleaning liquid container 3 can be removed from the housing 1.

Figure 5:
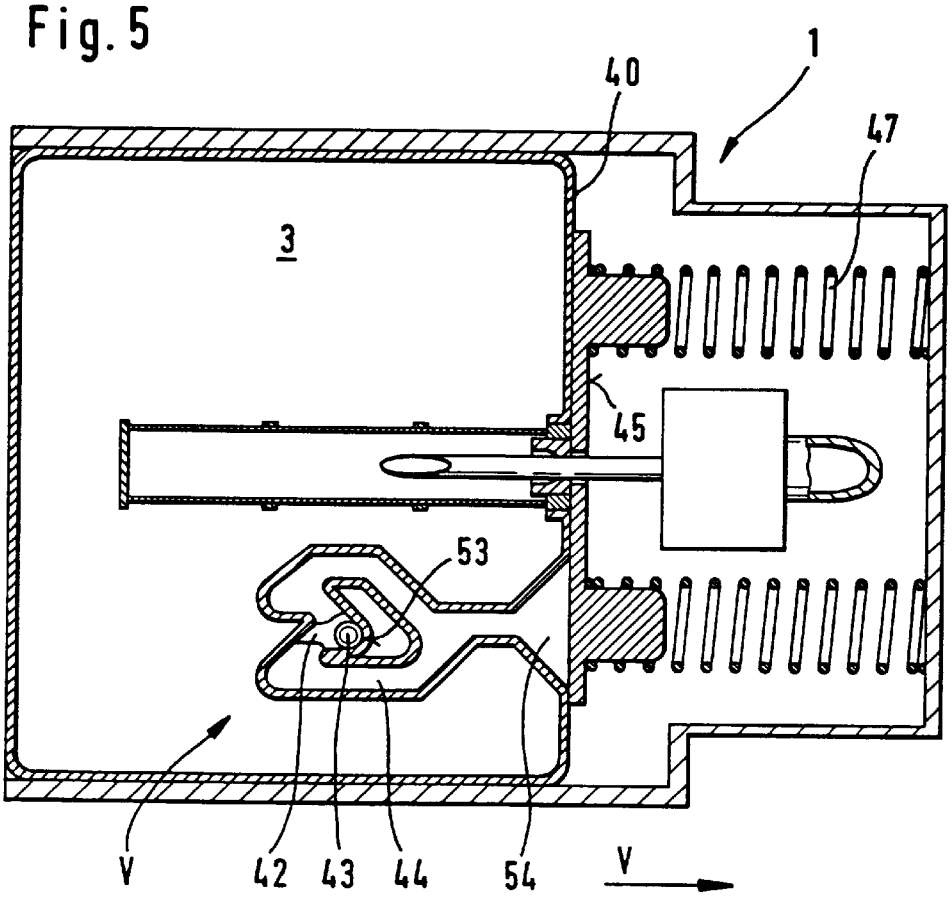
FIG. 5 is a view of the lower part of the housing and the cleaning liquid container of FIG. 4 in latched condition.

FIG. 5 shows a section through the housing 1 and the cleaning liquid container 3 of the cleaning device RV, including a sectional representation of a latching device V shown in latched condition. The control cam 43 integrally formed on the control element 42 is engaged in the latching position 53 provided in the guideway 44, being held in this latching position 53 under the action of the spring elements 47 acting through the pressure transmitting element 45 on the wall 40 of the cleaning liquid container 3. When a displacement pressure is exerted on the cleaning liquid container 3 against the pressure of the spring elements 47, the control cam is disengaged from the latching position 53, sliding along the guideway 44 to the lead-in path 54 so that in this unlatched position the cleaning liquid container 3 can be removed from the housing 1.

What is claimed is:

1. A cleaning device for cleaning a shaving head of a dry shaving apparatus, the cleaning device comprising:

a housing including a cleaning basin and a holding device, the cleaning basin defining an outlet port;

an exchangeable cleaning liquid container arranged underneath the cleaning basin, the container containing a cleaning liquid and having a filter integrated therein, the filter including an inner chamber, a wall of the container defining an inlet port for admitting cleaning liquid drained from the outlet port of the cleaning basin; and a feed device adapted to be driven by a motor, the feed device including a supply pipe leading to the cleaning basin, the feed device being adapted to aspirate the cleaning liquid from the cleaning liquid container through the inner chamber of the filter and the supply pipe to the cleaning basin, wherein a backflow of the cleaning liquid can be effected from the supply pipe through the feed device and the filter to the cleaning liquid container.

2. The cleaning device of claim 1, wherein the supply pipe comprises a riser for the cleaning liquid.

3. The cleaning device of claim 2, wherein the back flow of the cleaning liquid is ensured by lifting the cleaning liquid to a level in the riser that exceeds a liquid level in the cleaning liquid container.

4. The cleaning device of claim 2, further comprising a pressure accumulator to ensure the backflow of the cleaning liquid, wherein the pressure accumulator is disposed in the riser.

5. The cleaning device of claim , wherein the supply pipe comprises a riser and a downpipe.

6. The cleaning device of claim 1, further comprising a pressure accumulator to ensure the backflow of the cleaning liquid.

7. The cleaning device of claim 6, wherein the pressure accumulator is adapted to be pressurized by the cleaning liquid in operation of the feed device.

8. The cleaning device of claim 7, wherein deactivation of the feed device ensures the backflow of cleaning liquid through the feed device and the filter by means of hydrostatic pressure stored in the pressure accumulator.

9. The cleaning device of claim 8, wherein the pressure accumulator comprises a cylinder piston and a spring element, the cylinder piston being displaceable against the spring element.

10. The cleaning device of claim 5, further comprising a pressure accumulator to ensure the backflow of the cleaning liquid, wherein a supply of the cleaning liquid from the riser to the downpipe is controllable by the pressure accumulator.

* * * * *